US007204315B2

(12) United States Patent
Pia

(10) Patent No.: US 7,204,315 B2
(45) Date of Patent: Apr. 17, 2007

(54) DUAL VALVE WELL CONTROL IN UNDERBALANCED WELLS

(75) Inventor: Giancarlo Tomasso Pietro Pia, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/296,295

(22) PCT Filed: Oct. 17, 2001

(86) PCT No.: PCT/GB01/04619

§ 371 (c)(1),
(2), (4) Date: Nov. 21, 2002

(87) PCT Pub. No.: WO02/33215

PCT Pub. Date: Apr. 25, 2002

(65) Prior Publication Data

US 2003/0150621 A1 Aug. 14, 2003

(30) Foreign Application Priority Data

Oct. 18, 2000 (GB) ..... 0025515.8

(51) Int. Cl.
*E21B 34/08* (2006.01)
*E21B 34/16* (2006.01)

(52) U.S. Cl. ..... 166/373; 166/53; 166/319; 166/386

(58) Field of Classification Search ..... 166/373, 166/53, 386, 319, 336, 363; 251/12, 14
See application file for complete search history.

(56) References Cited

U.S. PATENT DOCUMENTS 2,587,539 A * 2/1952 Seaman ..... 137/628
3,724,501 A * 4/1973 Scott ..... 137/630.19
3,799,269 A 3/1974 Brown et al. ..... 166/315
3,967,647 A * 7/1976 Young ..... 137/614.11
4,116,272 A * 9/1978 Barrington ..... 166/340
4,144,937 A * 3/1979 Jackson et al. ..... 166/373
4,197,879 A 4/1980 Young
4,201,363 A 5/1980 Arendt et al.
4,306,623 A * 12/1981 Brooks ..... 166/322
4,368,871 A 1/1983 Young
4,619,325 A * 10/1986 Zunkel ..... 166/374
4,651,828 A * 3/1987 Doremus ..... 166/319
4,880,060 A * 11/1989 Schwendemann et al. .. 166/336
4,896,722 A * 1/1990 Upchurch ..... 166/250.15
4,903,775 A * 2/1990 Manke ..... 166/373
4,926,945 A 5/1990 Pringle et al.

(Continued)

FOREIGN PATENT DOCUMENTS

| | | |
|---|---|---|
| EP | 0 915 230 | 5/1999 |
| GB | 2 323 399 | 9/1998 |
| GB | 2337544 | 11/1999 |
| WO | WO 99/63234 | 12/1999 |
| WO | WO 00/75477 | 12/2000 |
| WO | WO 01/04456 | 1/2001 |

*Primary Examiner*—Kenneth Thompson
(74) *Attorney, Agent, or Firm*—Patterson & Sheridan, L.L.P.

(57) ABSTRACT

A method of isolating a reservoir of production fluid in a formation comprises providing a pair of valves (14, 16) in a bore intersecting a production formation and in which the hydrostatic pressuer in the bore at the formation is normally lower than the formation pressure, and then ontrolling the valves (14, 16) from surface such that the valves (14, 16) will only move from a closed configuration to an open configuration on experiencing a predetermined differential pressure across the valves.

41 Claims, 3 Drawing Sheets

U.S. PATENT DOCUMENTS 5,022,427 A 6/1991 Churchman et al. ..... 137/155
5,251,702 A 10/1993 Vazquez
5,285,850 A 2/1994 Bayh, III
5,564,502 A 10/1996 Crow et al.
5,823,265 A 10/1998 Crow et al. ..... 166/373
5,848,646 A 12/1998 Huber et al.
5,857,523 A 1/1999 Edwards
5,865,254 A 2/1999 Huber et al. ..... 166/373
5,971,353 A 10/1999 Johnson
6,015,014 A 1/2000 Macleod et al.
6,056,055 A 5/2000 Falconer et al. ..... 166/297
6,142,226 A 11/2000 Vick
6,152,229 A * 11/2000 Jennings ..... 166/321
6,152,232 A 11/2000 Webb et al.
6,167,974 B1 1/2001 Webb
6,209,663 B1 4/2001 Hosie
6,227,299 B1 5/2001 Dennistoun
6,250,383 B1 6/2001 Patel
6,315,047 B1 11/2001 Deaton et al.
6,343,658 B2 2/2002 Webb
6,401,826 B2 6/2002 Patel
6,644,411 B2 11/2003 Compton et al.
6,962,215 B2 11/2005 Curtis et al.

* cited by examiner

DUAL VALVE WELL CONTROL IN UNDERBALANCED WELLS

This invention relates to well control, and in particular to a method and apparatus for use in controlling access and flow to and from a subsurface well.

In the oil and gas exploration and production industry, bores are drilled to access subsurface hydrocarbon-bearing formations. The oil or gas in the production formation is under pressure, and to prevent uncontrolled flow of oil or gas from the formation to the surface, that is a "blowout", it has been conventional to fill the bore above the formation with fluid of sufficient density that the hydrostatic pressure head provided by the column of fluid retains the oil or gas in the formation. However, it has been recognised that this practice may result in damage to the formation, and may significantly reduce the productivity of the formation. This problem has recently come to the fore as deeper and longer bores are drilled, and thus the hydrostatic pressure of drilling fluid or "mud" increases, and further as the pressures necessary to circulate drilling fluid and entrain cuttings in the conventional manner increases.

One result of these experiences and findings has been the development of technology and methods which permit "under-balanced" drilling, that is a drilling operation in which the pressure of the drilling fluid is lower than the formation fluid pressure, such that oil and gas may flow from the formation and commingle with the drilling fluid. The fluids travel together to the surface and are separated at surface. In many cases, use of underbalanced drilling has resulted in marked increases in well productivity.

However, one difficulty associated with underbalanced drilling is the relatively high fluid pressures that are experienced at surface. This places an increased reliance on surface sealing arrangements, and generally increases the difficulty in controlling the well; the conventional high density fluid column is not present, and in the event of difficulties, pumping higher density fluid into the well to "kill" or control the well may take some time and is likely to result in damage to the formation, perhaps to an extent where the well must be abandoned.

There is also a difficulty associated with making up drill string and the like to be run into such wells, or indeed in any well where the pressure at surface is relatively high. In such wells, the relatively high fluid pressure (which may be several hundred atmospheres) will tend to push the drill string up and out of the well, such that making up such a string becomes a difficult and potentially dangerous operation. This difficulty persists until the weight of the string is sufficient to counteract the pressure force.

It has been proposed to avoid or overcome at least some of these difficulties by placing a flapper valve in a lower section of a well, the valve closing when the pressure forces acting from below the valve are greater than the pressure forces acting from above the valve. This places restrictions of the placement of the valve which, to be effective, must be located close to the pressure balance point in the well, that is the point where the upward acting fluid pressure force, or reservoir pressure, equals the downward acting force from the pressure head produced by the column of fluid in the bore. Further, while such a valve may assist in preventing uncontrolled flow from a formation, the valve will not serve to protect a formation from damage or contamination in the event that the pressure above the valve rises; in such a situation elevated pressure above the valve will tend to open the valve. Similarly, testing the valve presents difficulties, as higher test pressures will tend to open the valve, and therefore no pressure greater than reservoir pressure may be safely utilised, as a higher pressure would run the risk of damaging the formation.

It is among the objectives of embodiments of the present invention to obviate or mitigate these disadvantages.

According to one aspect of the present invention there is provided a method of isolating a reservoir of production fluid in a formation, the method comprising:

providing a valve in a bore intersecting a production formation and in which the hydrostatic pressure in the bore at the reservoir is normally lower than the formation pressure; and controlling the valve from surface such that the valve will only move from a closed configuration to an open configuration on experiencing a predetermined differential pressure thereacross.

The invention also relates to an apparatus for use in isolating a reservoir of production fluid in a formation, the apparatus comprising:

a valve adapted for location in a bore intersecting a production formation and in which the hydrostatic pressure in the bore at the reservoir is normally lower than the formation pressure;

first valve control means for permitting control of the valve from surface; and second valve control means for permitting control of movement of the valve from a closed to an open configuration in response to a predetermined differential pressure across the valve.

Preferably, the valve is controlled such that it will only open when there is little or no pressure differential across the valve. Thus, as the valve opens there is little if any flow of fluid through the valve as the pressure equalises; opening the valve in the presence of a pressure differential may result in the rapid flow of fluid through the valve as it opens, with an increased likelihood of erosion and damage to the valve. In under-balanced and live well applications this allows the valve to hold pressure from one or both sides, and minimises the risk of formation damage or contamination when the pressure above the valve is higher than the pressure below the valve. Further, this feature may be utilised to minimise the risk of uncontrolled flow of fluid from the formation, in the event of pressure below the valve being higher than the pressure above the valve.

The valve may be positioned above, at or below the pressure balance point.

Preferably, the valve is controlled from surface by fluid pressure, the control fluid supply of gas or liquid being isolated from the well fluid, for example in control lines or in a parasitic annulus. The valve may include a control fluid piston, application of control fluid thereto tending to close the valve. Preferably, the valve is further also responsive to well fluid pressure, and in particular to the differential well fluid pressure across the valve, such that the closed valve will remain closed or will open in response to a selected control pressure in combination with a selected differential pressure. The valve may include a piston in communication with fluid below the valve and a piston in communication with fluid above the valve; application of pressure to the former may tend to close the valve, while application of pressure to the latter may tend to open the valve. In a preferred embodiment, a selected first control pressure will close the valve. Such a first control pressure in combination with a higher pressure below the valve will tend to maintain the valve closed. Further, increasing the control pressure will maintain the valve closed in response to a higher pressure above the valve. This facility also allows the applied control pressure to be brought to a particular value, the pressure differential across the valve to be minimised and the control fluid pressure then varied to allow the valve to open.

Preferably, the valve is a ball valve. However, the valve may also be a flapper valve, or indeed any form of valve appropriate to the application.

Preferably, the valve comprises two valve closure members, which may be two ball valves, two flapper valves, or even a combination of different valve types. The valves may have independent operating mechanisms. The valve closure members may close simultaneously, or in sequence, and preferably the lowermost valve member closes first. This allows the valves to be pressure-tested individually. Sequenced closing may be achieved by, for example, providing the valve members in combination with respective spring packs with different pre-loads.

Preferably, the valve is run into a cased bore on intermediate or parasitic casing, thus defining a parasitic annulus, between the existing casing and the parasitic casing, via which control pressure may be communicated to the valve. The parasitic casing is sealed to the bore-lining casing at or below the valve, typically using a packer or other sealing arrangement. The parasitic annulus may be used to carry fluids, for example to allow nitrogen injection in the well below the valve. For example, additional casing may be hung off below the valve to extend the parasitic annulus, and a pump open\pump closed nitrogen injection valve provided to selectively isolate the parasitic annulus from the well bore annulus. In other embodiments the parasitic annulus may be utilised to carry gas or fluid lift gas or fluid to a point in the well above the valve, or even between a pair of valves. One or more one-way valves may be provided and which may be adapted to open at a parasitic pressure in excess of that required to close the valve or perform pressure tests above the valve. Such an arrangement may be utilised to circulate out a column of well kill fluid, prior to opening the valve, or alternatively to inject a fluid slug prior to opening the valves, or to inject methanol from the parasitic annulus to prevent hydrate formation.

The valve may be configured to allow the valve to be locked open, for example by locating a sleeve in the open valve.

The valve may be configured to permit pump-though, that is, on experiencing a sufficiently high pressure from above, the valve may be moved, for example partially rotated in the case of a ball valve, to permit fluid flow around the nominally closed valve.

According to another aspect of the present invention there is provided an apparatus for use in isolating a reservoir of production fluid in a formation, the apparatus comprising:

a valve adapted for location in a bore intersecting a production formation and in which the hydrostatic pressure in the bore at the reservoir is normally lower than the formation pressure; and first valve control means for permitting control of the valve from surface, the valve including two valve closure members, both valve closure members being adapted to hold pressure both from above and from below.

Preferably, the valve closure members are ball valves. Alternatively, the valve closure members are flapper valves.

Preferably, the valve closure members are independently operable.

These and other aspects of the present invention will now be described, by way of example, with reference to the accompanying drawings, in which.

Figure 1:
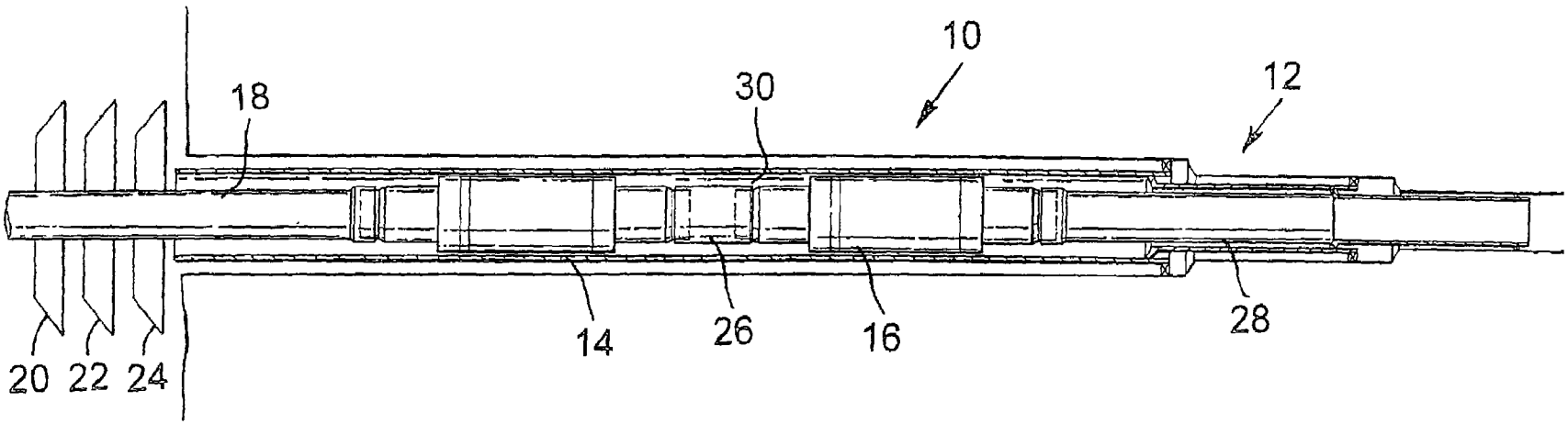
FIG. 1 is a schematic illustration of apparatus for use in isolating a reservoir in accordance with a preferred embodiment of the present invention, shown located in a well.

Reference is first made to FIG. 1 of the drawings, which is a schematic illustration of apparatus 10 for use in isolating a reservoir in accordance with a preferred embodiment of the present invention, the apparatus 10 being shown located in a well 12. The illustrated well features three main sections, that is a 17½ inch diameter hole section lined with 13⅜ inch diameter casing, a 12¼ inch hole section lined with 9⅝ inch casing, and an 8½ inch hole section lined with 7 inch casing; those of skill in the art will of course recognise that these dimensions are merely exemplary, and that the apparatus 10 may be utilised in a wide variety of well configurations. The apparatus 10 is located within the larger diameter first well section and comprises upper and lower valves 14, 16. As will be described, the valves 14, 16 are similar, with only minor differences therebetween. The valves are mounted on tubing 18 which extends from the surface, through a rotating blow-out preventer (BOP) 20, an annular preventer 22, and a standard BOP 24. An intermediate tubular connector 26 joins the valves 14, 16, and a further section of tubing 28 extends from the lower valve 16, through the 9⅝ inch casing, to engage and seal with the upper end of the 7 inch casing. Thus, an isolated annulus 30 is formed between the valves 14, 16 and the tubing 18, 28, and the surrounding casing; this will be referred to as the parasitic annulus 30.

The apparatus 10 will be described with reference to an under-balanced drilling operation, and in such an application a tubular drill string will extend from surface through the valves 14, 16 and the tubing 18, 28.

Figure 2:
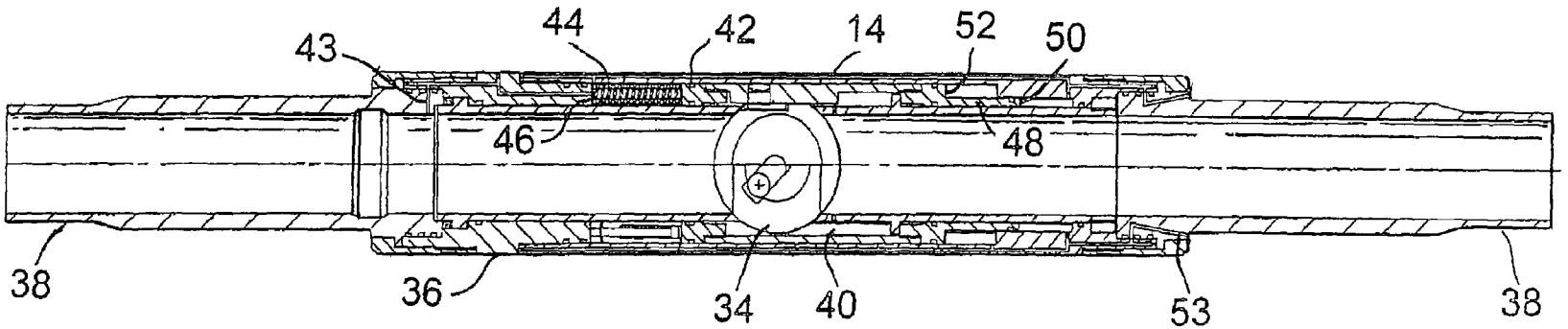
FIG. 2 is an enlarged sectional view of valves of the apparatus of FIG. 1.
Figure 2:
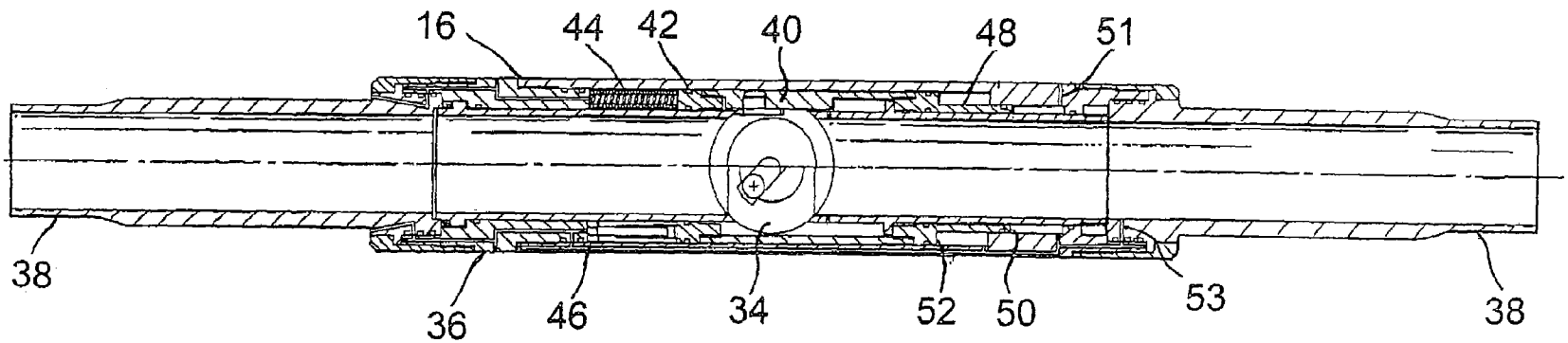
Figure 3:
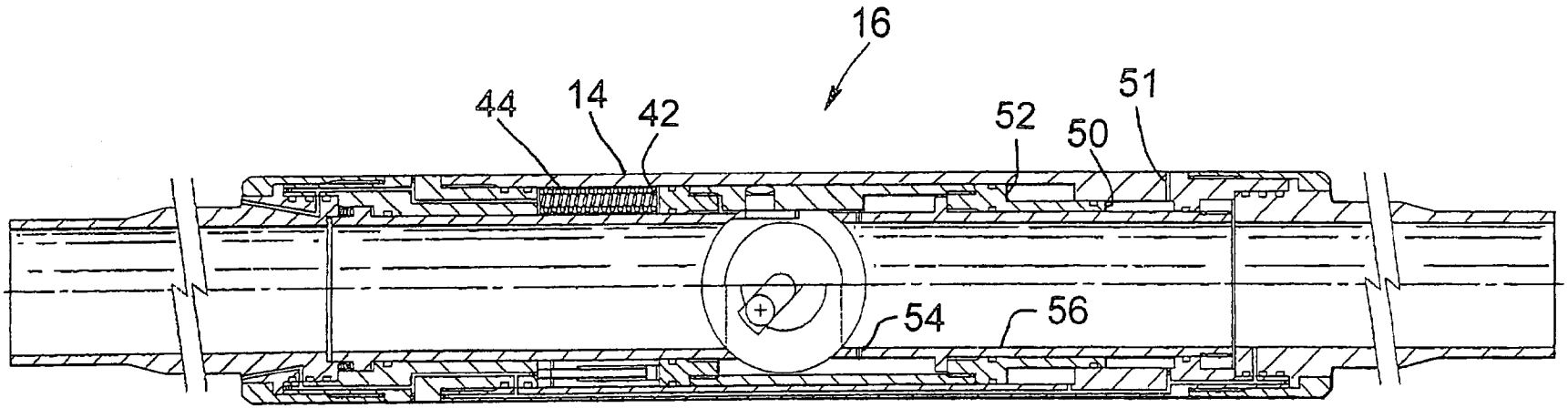
FIG. 3 is a further enlarged sectional view of one of the valves of the apparatus of FIG. 1.

Reference is now also made to FIG. 2 of the drawings, which is an enlarged sectional view of the valves 14, 16, shown separated. Reference will also be made to FIG. 3 of the drawings which is an enlarged sectional view of the lower valve 16. As the only differences between the valves 14, 16 is the pre-loading on the valve closing spring and the arrangement of porting for valve control fluid, only one of the valves 16 will be described in detail, as exemplary of both. The valve 16 is a ball valve and therefore includes a ball 34 located within a generally cylindrical valve body 36, and in this example the ends of the body 36 feature male premium connections 38 for coupling to the tubing section 18 and the connector 26.

The ball 34 is mounted in a ball cage 40 which is axially movable within the valve body 36 to open or close the valve. The valve 16 is illustrated in the closed position. Above the cage 40 is an upper piston 42 which is responsive to fluid pressure within the tubing 18 above the valve 14, communicated via porting 43. Further, a power spring 44 is located between the piston 42 and a top plate 46 which is fixed relative to the valve body 36. Accordingly, the spring 44, and fluid pressure above the ball 34, will tend to move the valve ball 34 to the open position.

Below the cage 40 is a lower piston 48 which, in combination with the valve body 36, defines two piston areas, one 50 in fluid communication with the parasitic annulus 30, via porting 51, and the other 52 in communication, via porting 53, with the tubing below the valves 14, 16, that is the reservoir pressure In use, in the absence of any pressure applied to the valves 14, 16 via the parasitic annulus 30, the springs 44 will urge the valve balls 34 to the open position, allowing flow through the valves 14, 16. If however it is desired to close the valve, the pressure in the parasitic annulus 30 is increased, to increase the force applied to the parasitic pistons 50. The pre-load on the spring 44 in the lower valve 16 is selected to be lower than the pre-load of the spring 44 in the upper valve 14, such that the lower valve 16 will close first. Thus, the effectiveness of the seal provided by the lower valve 16 may be verified. A further increase in pressure in the parasitic annulus 30 will then also close the upper valve 14.

The valve balls 34 are designed to permit cutting or shearing of lightweight supports such as slickline, wireline or coiled tubing, passing through the apparatus 10, such that the valves may be closed quickly in an emergency situation without having to withdraw a support form the bore.

With the valves 14, 16 closed, the reservoir is now isolated from the upper section of the well. This facilitates various operations, including the retrieval, making up and running in of tools, devices and their support strings above the apparatus 10, or the circulation of fluids within the upper end of the tubing 18 to, for example, fill the tubing 18 with higher or lower density fluid.

In the event that the reservoir pressure below the valves 14, 16 is higher than the pressure in the tubing 18 above the valves 16, 18, the reservoir pressure acting on the pistons 52 will tend to maintain the valves 14, 16 closed, thus preventing uncontrolled flow of formation fluids from the reservoir.

In the event that the pressure differential is reversed, that is the pressure force above the valves 14, 16 is greater than the reservoir pressure acting below the valves 14, 16, the parasitic pressure may be increased to increase the valve closing force acting on the pistons 50, to counteract the valve opening force acting on the pistons 42.

The area of the upper piston 42 is equal to the combined areas of the parasitic and reservoir pistons 50, 52, while the parasitic piston 50 is larger than the reservoir piston 52. Thus, if it is desired to open the valve from a closed position, this is normally achieved by increasing the pressure in the parasitic annulus 30 to a point where the parasitic pressure is substantially similar to the reservoir pressure. The pressure in the tubing 18 is then increased, and as the tubing pressure approaches the reservoir pressure the forces acting on the pistons 42 reach a level similar to the oppositely acting forces on the lower pistons 48, such that the springs 44 will tend to open the valves when the parasitic pressure is vented at surface.

While the parasitic pressure remains vented, the springs 44 will retain the valves open.

With this arrangement it would be possible to open the valves when the tubing pressure above the valves 14, 16 was lower than reservoir pressure, if the parasitic pressure was not increased to be greater or equal to the reservoir pressure. However, this would result in the valves 14, 16 opening with a pressure differential, and the resulting rapid flow of fluid through the valves would bring an increase likelihood of erosion and damage to the valves and upstream equipment.

In the event that one or both of the valves cannot be opened, and it is desired to, for example, "kill" the well, it sufficient tubing pressure is applied from surface the valve balls 34 will be pushed downwardly to an extent that kill fluid may pass around the balls 34 and then out of pump-through ports 54 provided in the lower ball seats 56.

If desired, one or more one-way valves may be provided in the tubing 28 or valve body 36. For example, one or more one-way pressure relief valves may be provided above the upper valve 14, and configured to pass gas or fluid from the parasitic annulus into the tubing 18. Such a valve positioned just above or between the valves 14, 16 may be used to, for example, circulate out a column of well kill fluid prior to opening the valve, or to inject a fluid slug prior to opening the valves. Such a valve could also be used to inject methanol from the parasitic annulus 30 on top of the upper valve 14 to prevent hydrate formation. Alternatively, a one-way valve could be incorporated between the valves 14, 16. Of course, such a valve or valves would only open in response to a parasitic annulus pressure in excess of that required to close the valves, to perform a pressure test from above a closed valve, or to support a column of well kill fluid above the valves.

In the illustrated embodiment the provision of the parasitic annulus may also be used to advantage to, for example, allow nitrogen injection in the well below the apparatus 10. For example, a nitrogen injection point could be provided on the tubing 28 below the apparatus 10. Of course the injection point would have to be isolated from the tubing bore using a pump open\pump close nitrogen injection valve.

From the above description it will be apparent to those of skill in the art that the apparatus described above provides a safe and convenient method of isolating a reservoir, and the ability of the valves to hold pressure from both above and below is of considerable advantage to the operator, and provides additional safeguards and convenience in underbalanced drilling, at balance drilling or live well\light weight intervention environments, most particularly in the deployment of drilling assemblies, intervention assemblies, workover assemblies, completions, liners, slotted liners or sandscreens.

Those of skill in the art will also recognise that the illustrated embodiment is merely exemplary of the present invention, and that various modifications and improvements may be made thereto without departing from the scope of invention. For example, rather than controlling the operation of the valves 14, 16 via the parasitic annulus 30, conventional control lines may be run from surface to supply control fluid to the valves. Further, rather than providing valves in individual housings, a common housing assembly for both valves could be provided. The above described valve arrangements rely primarily on metal-to-metal seals between the balls and the valve seats, and of course in other embodiments elastomeric seals may also be provided. The valves illustrated and described above are in the form of ball valves, though those of skill in the art will recognise that flapper valves may also be utilised, particularly flapper valves having the facility to be held closed in response to both pressure from above and from below.

The invention claimed is:

1. A method of isolating a reservoir of production fluid in a formation, the method comprising:

providing a valve in a bore intersecting a production formation and in which the hydrostatic pressure in the bore at the formation is normally lower than the formation pressure, wherein the valve is initially open;

positioning the valve below the pressure balance point;

applying a selected first control pressure to close the valve, wherein the first control pressure in combination with a higher pressure below the valve maintains the valve closed; and controlling the valve from surface such that the valve will move from a closed configuration to an open configuration only at a predetermined differential pressure thereacross.

2. The method of claim 1, wherein the valve is controlled such that it will only open when there is little or no pressure differential across the valve.

3. The method of claim 2, wherein the bore is formed by underbalanced drilling.

4. The method of claim 1, wherein the closed valve is controlled to hold higher pressure above the valve.

5. The method of claim 1, wherein the closed valve is controlled to hold higher pressure below the valve.

6. The method of claim 1, wherein the closed valve is controlled to hold pressure from both sides.

7. The method of claim 1, wherein the valve is controlled from surface by fluid pressure.

8. The method of claim 1, wherein a control fluid supply is supplied from surface to the valve through at least one control line.

9. The method of claim 1, wherein a control fluid supply is supplied from surface to the valve through a parasitic annulus.

10. The method of claim 1, further comprising applying a higher pressure below the valve to maintain the valve closed, without continued application of said control pressure.

11. The method of claim 1, comprising increasing said control pressure to maintain the valve closed in response to a higher pressure above the valve.

12. The method of claim 1, comprising bringing the applied control pressure to a particular value, minimizing the pressure differential across the valve, and then varying the control fluid pressure to open the valve.

13. The method of claim 1, further comprising locking the valve open.

14. The method of claim 1, comprising providing two similar valves in the bore.

15. The method of claim 14, further comprising closing the valves simultaneously.

16. The method of claim 14, further comprising closing the valves in sequence.

17. The method of claim 16, further comprising closing a lowermost valve first.

18. The method of claim 16, further comprising initially closing a lowermost valve.

19. The method of claim 1, comprising running the valve into a cased bore on intermediate or parasitic casing, thus defining a parasitic annulus between the existing casing and the parasitic casing.

20. The method of claim 19, further comprising sealing the parasitic casing to the bore-lining casing at or below the valve.

21. The method of claim 20, further comprising carrying fluids into the bore below the valve through the parasitic annulus.

22. The method of claim 21, wherein the fluid is nitrogen and the nitrogen is injected in the bore below the valve.

23. The method of claim 20, further comprising carrying gas, fluid lift gas or fluid to a point in the bore above the valve.

24. The method of claim 20, further comprising providing at least one one-way valve between the parasitic annulus and the bore and opening the one-way valve in response to a parasitic pressure in excess of that required to function the valve or perform pressure tests on the valve.

25. The method of claim 24, further comprising circulating out a column of well kill fluid above the valve via the parasitic annulus and the one-way valve prior to opening the valve.

26. The method of claim 24, further comprising injecting a fluid slug via, the parasitic annulus and the one-way valve prior to opening the valve.

27. A method for controlling a pressure surge in a string of down hole tubulars comprising;

closing a first valve in response to the pressure surge;

opening the first valve by application of a first fluid pressure from the surface;

closing a second valve in response to the application of the first fluid pressure; and opening the second valve in response to a second fluid pressure applied from the surface.

28. An apparatus for use in isolating a reservoir of production fluid in a formation, the apparatus comprising:

a valve system in a production tubular having:

a first valve having:

a first valve control for permitting control of the first valve from surface; and a second valve control for permitting control of movement of the first valve from a closed to an open configuration in response to the predetermined differential pressure across the first valve; and a second valve, wherein each valve is controlled with a differential pressure across the valve and the differential pressure that controls the first valve is the fluid pressure outside the production tubular and the fluid pressure inside the production tubular.

29. The apparatus of claim 28, wherein the first valve control is operable to move the first valve from the open configuration to the closed configuration.

30. The apparatus of claim 28, wherein the first valve is adapted to hold pressure from at least one side.

31. The apparatus of claim 28, wherein the first valve is adapted to hold pressure from both sides.

32. The apparatus of claim 28, wherein the first valve control is responsive to the fluid pressure outside the production tubular.

33. The apparatus of claim 28, further comprising a parasitic casing for defining a control fluid-carrying parasitic annulus.

34. The apparatus of claim 28, wherein the first and second valves have independent operating mechanisms.

35. The apparatus of claim 28, wherein in the open configuration the first valve allows for passage of downhole tools.

36. A method of isolating a reservoir of production fluid in a formation, the method comprising:

providing a valve in a bore intersecting a production formation and in which the hydrostatic pressure in the bore at the formation is normally lower than the formation pressure, wherein the valve is initially open;

applying a selected first control pressure to close the valve, increasing the first control pressure to maintain the valve closed in response to a higher pressure above the valve; and controlling the valve from surface such that the valve will move from a closed configuration to an open configuration only at a predetermined differential pressure thereacross.

37. A method of isolating a reservoir of production fluid in a formation, the method comprising:

providing a valve in a bore intersecting a production formation and in which the hydrostatic pressure in the bore at the formation is normally lower than the formation pressure, wherein the valve is initially open;

applying a selected first control pressure to close the valve, controlling the valve from surface such that the valve will move from a closed configuration to an open configuration only at a predetermined differential pressure thereacross;

bringing the first control pressure to a particular value, minimizing the pressure differential across the valve;

varying the control fluid pressure to open the valve.

38. A method of isolating a reservoir of production fluid in a formation, the method comprising:

providing a valve in a cased bore intersecting a production formation and in which the hydrostatic pressure in the bore at the formation is normally lower than the formation pressure;

running the valve into the cased bore on an intermediate casing, wherein an annulus is defined between the existing casing and the intermediate casing;

sealing the intermediate casing to the existing casing at or below the valve;

carrying fluids into the cased bore below the valve through the annulus, wherein the fluid is nitrogen and the nitrogen is injected in the cased bore below the valve;

controlling the valve from surface such that the valve will move from a closed configuration to an open configuration only at a predetermined differential pressure thereacross.

39. A method of isolating a reservoir of production fluid in a formation, comprising;

providing a valve in a bore intersecting a production formation and in which the hydrostatic pressure in the bore at the formation is normally lower than the formation pressure;

running the valve into a cased bore on intermediate or parasitic casing, thus defining a parasitic annulus between the existing casing and the parasitic casing;

sealing the parasitic casing to the bore-lining casing at or below the valve;

carrying fluids into the bore below the valve through the parasitic annulus, wherein the fluid is nitrogen and the nitrogen is injected in the bore below the valve; and controlling the valve from surface such that the valve will move from a closed configuration to an open configuration only at a predetermined differential pressure thereacross.

40. A method of isolating a reservoir of production fluid in a formation, the method comprising:

providing a valve in a bore intersecting a production formation and in which the hydrostatic pressure in the bore at the formation is normally lower than the formation pressure, wherein the valve is initially open;

positioning the valve at the pressure balance point;

applying a selected first control pressure to close the valve, wherein the first control pressure in combination with a higher pressure below the valve maintains the valve closed; and controlling the valve from surface such that the valve will move from a closed configuration to an open configuration only at a predetermined differential pressure thereacross.

41. A method of isolating a reservoir of production fluid in a formation, the method comprising:

providing a first valve in a bore intersecting a production formation and in which the hydrostatic pressure in the bore at the formation is normally lower than the formation pressure, wherein the first valve is initially open;

providing a second valve in the bore;

applying a selected first control pressure to close the first valve, wherein the first control pressure in combination with a higher pressure below the first valve maintains the first valve closed; and closing the second valve after the first valve;

controlling the first valve from surface such that the first valve will move from a closed configuration to an open configuration only at a predetermined differential pressure thereacross.

* * * * *